US009709365B2

(12) United States Patent
West

(10) Patent No.: US 9,709,365 B2
(45) Date of Patent: Jul. 18, 2017

(54) EDIBLE SKEET

(71) Applicant: Stephen R. West, San Antonio, TX (US)

(72) Inventor: Stephen R. West, San Antonio, TX (US)

(73) Assignee: Stephen R. West, San Antonio, TX (US)

( * ) Notice: Subject to any disclaimer, the term of this patent is extended or adjusted under 35 U.S.C. 154(b) by 0 days.

(21) Appl. No.: 15/073,440

(22) Filed: Mar. 17, 2016

(65) Prior Publication Data

US 2016/0273887 A1 Sep. 22, 2016

Related U.S. Application Data

(60) Provisional application No. 62/134,968, filed on Mar. 18, 2015.

(51) Int. Cl.
*F41J 9/16* (2006.01)
*F41J 1/01* (2006.01)

(52) U.S. Cl.
CPC .. *F41J 1/01* (2013.01); *F41J 9/16* (2013.01)

(58) Field of Classification Search
CPC ..... F41J 1/01; F41J 9/16; F41J 9/165
USPC ..... 273/362–365
See application file for complete search history.

(56) References Cited

U.S. PATENT DOCUMENTS 2,924,522 A * 2/1960 Gehrt ..... A23K 40/20 426/649
4,623,150 A * 11/1986 Moehlman ..... F41J 9/16 264/319
5,174,581 A * 12/1992 Goodson ..... A01K 39/0106 119/51.01
5,467,998 A * 11/1995 Hellings ..... F41J 1/01 119/51.01
5,651,550 A * 7/1997 LaVorgna ..... F41J 1/01 273/363
5,676,377 A * 10/1997 Lynn, Jr. ..... F41J 9/16 273/362
5,788,243 A * 8/1998 Harshaw ..... C08L 97/02 273/363
5,915,695 A * 6/1999 Wisocki ..... F41J 9/16 273/362
5,947,475 A * 9/1999 Skeuse ..... F41J 1/01 273/363
5,967,521 A * 10/1999 Hellings ..... A01K 5/00 273/363

(Continued)

*Primary Examiner* — Mark Graham
(74) *Attorney, Agent, or Firm* — Mossman, Kumar & Tyler, PC

(57) ABSTRACT

A frangible flying target for use in inanimate bird shooting. The target may include a body substantially formed from matter edible to animals. The body may include at least one of protein meal; urea; condensed distillers solubles; and cement. The protein meal may be encased in an edible binder. Making the target may be carried out by mixing the ingredients and curing in a desired target shape. This may be carried out by molding. In other examples, the target may be made by making a blank using molding or extrusion, and then trimming or machining the blank to the desired target shape. The mixture may comprise, by total weight of the mixture, 5-20 percent cement, 0.5-25 percent molasses, 0-10 percent salt, and 0.5-10 percent urea; and water.

4 Claims, 1 Drawing Sheet

(56) References Cited

U.S. PATENT DOCUMENTS

| | | | | |
|---|---|---|---|---|
| 2002/0060428 | A1* | 5/2002 | Warren | F41J 1/01 273/362 |
| 2010/0207331 | A1* | 8/2010 | Boeh | F41J 9/16 273/362 |

* cited by examiner

EDIBLE SKEET

CROSS-REFERENCE TO RELATED APPLICATIONS

This application claims benefit of U.S. Provisional Patent Application No. 62/134,968, filed Mar. 18, 2015 and incorporated herein by reference in its entirety.

FIELD

The present disclosure relates generally to specialty targets for inanimate bird shooting, wherein participants attempt to shoot flying targets, known as "clay pigeons," using a firearm.

BACKGROUND

Traditionally, in the sport of inanimate bird shooting, frangible clay targets are launched into the air (by hand or using a machine designed for this purpose), where participants attempt to shoot them during flight. The targets are designed to break upon being hit so that a successful shot is easily recognized. Optimally, the target shatters or disintegrates into tiny fragments.

SUMMARY

Aspects of the present disclosure relate to an improved edible flying target and apparatus, compositions, systems, and methods for their manufacture. Some aspects of the present disclosure include mixtures or compounds from which animal edible flying targets are made.

General embodiments include a frangible flying target for use in inanimate bird shooting. The target may include a body substantially formed from matter edible to animals. The body may include at least one of protein meal; urea; condensed distillers solubles; and cement. The term protein meal, as used herein, refers to one of animal byproduct meal, seed meal, or proprietary multi-component protein meals. Examples of protein meal include bone meal, cottonseed meal, rapeseed meal, canola meal, poultry byproduct meal, and so on. The protein meal may be encased in an edible binder, such as cement, starch, glycerin, or gum arabic. Making the target may be carried out by mixing the ingredients and curing in a desired target shape. This may be carried out by molding. In other examples, the target may be made by making a blank using molding or extrusion, and then trimming or machining the blank to the desired target shape. The mixture may comprise, by total weight of the mixture, 5-20 percent cement, 0.5-25 percent molasses, 0-10 percent salt, and 0.5-10 percent urea; and water.

The foregoing and other objects, features and advantages of the disclosure will be apparent from the following more particular descriptions of exemplary embodiments of the disclosure as illustrated in the accompanying drawings wherein like reference numbers generally represent like parts of exemplary embodiments of the disclosure.

BRIEF DESCRIPTION OF THE DRAWINGS

The following figures are part of the present specification, included to demonstrate certain aspects of embodiments of the present disclosure and referenced in the detailed description herein. Unless otherwise noted, figures are not drawn to scale.

DETAILED DESCRIPTION

Figure 1:
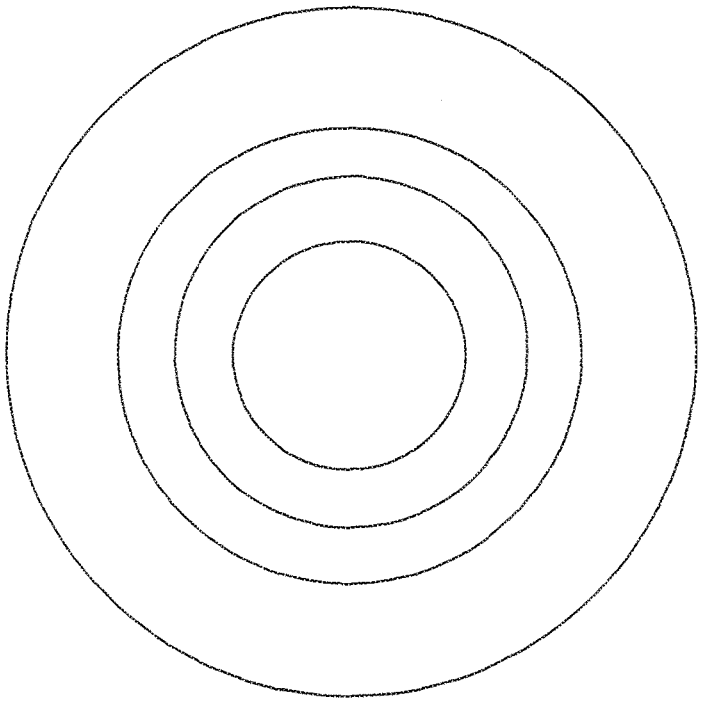
FIGS. 1 and 2 illustrate a frangible flying target in accordance with embodiments of the disclosure.

In inanimate bird shooting, traditional frangible clay targets break into small fragments when shot. Although these fragments are not biodegradable or easily digested by animals, it is known for fish, wildlife, and grazing animals to ingest these fragments. It would be desirable for the remnants of broken "clay pigeons" to consist of materials that are nutritious to animals expected to encounter them.

More recently, attempts at an edible skeet target have been made. Typical ingredients include birdseed or grain with binders such as baked egg or flour mixtures, or the like, or solidified molasses, sugar, syrup, and so on. While better for animals than their predecessors, these previous examples of edible skeet are still less than optimal sources of nutrition for fish, wildlife and especially grazing animals. This is particularly so in the case of cattle.

Further, ingredients and methods of manufacture known to the prior art exhibit characteristics which may be considered problematic. The mechanical requirements of frangible targets for inanimate bird shooting are exacting. The targets must be stackable and transportable without breaking. They must be easily separable when removed from packaging and loaded into the launcher (e.g., a trap thrower). Targets must withstand tremendous forces when launched into the air. The targets should not foul the launcher. And they must reliably shatter when hit. Each of the previous attempts in the prior art fails in at least one of these areas.

Further, as a well-developed and competitive sport, inanimate bird shooting relies on consistent and predictable flight characteristics from the targets. This, in turn, requires rigorous adherence to manufacturing tolerances. Producing targets under such demanding requirements using prior art techniques is problematic.

Aspects of the present disclosure relate to an improved edible skeet target and apparatus, compositions, systems, and methods for their manufacture. Some aspects of the present disclosure include mixtures or compounds from which edible skeet are made.

Example embodiments were chosen and described in order to best explain the principles of the disclosure and their practical application, and to enable others of ordinary skill in the art to understand the disclosure for various embodiments with various modifications as are suited to the particular use contemplated. Those skilled in the art will understand, however, that the invention may be embodied as many other devices, compositions, systems, and methods. For example, various aspects of the methods and devices may be combined in various ways or with various products, including existing products. Many modifications and variations will be apparent to those of ordinary skill in the art. The scope of the invention is not intended to be limited by the details of example embodiments described herein. The scope of the disclosure should be determined through study of the appended claims.

Specific design details have been provided for illustration, but should not be considered limiting. Readers of skill in the art will recognize that many variations of mixtures and processes for manufacture may be implemented consistent with the scope of the disclosure as described by the appended claims.

Figure 2:
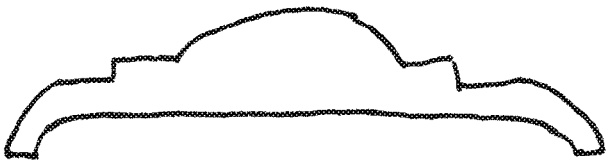

FIG. 1 shows a top view of a target in accordance with embodiments of the present disclosure. FIG. 2 shows a cross-sectional view of the target. In use, the improved nutritional target (hereinafter referred to for convenience as 'edible skeet target', or simply, 'target') will have the same dimensions as a conventional target. Thus, for standard targets, the target is generally disc shaped with a hollow dome and having a diameter of 108-110 mm (approximately 4.25 inches) and a height of 25-29 mm (approximately an inch), depending on the target's designation for either United States or international competition. Sporting clays and trap shooting may also include additional target types having different dimensions. In some instances, the finished target is approximately 100 or 105 grams in weight. The target is constructed to resist breaking when stacked for shipping and remain intact when thrown by a trap mechanism, but to experience dramatic structural failure when hit by a projectile.

In a first general embodiment, the targets are made by molding raw material using, for example, bi-valve molding. The target may be allowed to harden in the mold over time (e.g., 3-14 days). The mold may be coated with a releasing agent, which may be inert, biodegradable, or edible (e.g., vegetable oil).

Curing may be aided by the application of heat to the mixture while in the mold, which may allow for decreased curing time. Application of dry heat may be performed prior to curing (with or without a vacuum) to avoid density variations in the target. In other instances, the green molded target may be allowed to dry before firing. The target may be trimmed to meet specifications before or after firing.

In some embodiments, a preconditioner is used to inject uniform mixed steam, water, fats meat slurry, and/or other ingredients into the protein meal or cereal grain stock prior to its introduction into a vessel or mold for compression cooking of the premixed raw materials until the desired product characteristics are obtained. Direct steam injection may be used to aid in cooking or other chemical reactions.

Targets Configured for Ruminant Consumption

In embodiments for ruminant animals described hereinbelow, the raw material formula may comprise a fibrous feed ingredient, along with bonding agents and urea—cement is one bonding agent. Alternative bonding agents may include calcium oxide, calcium hydroxide, magnesium oxide, or bentonite. Minerals and molasses may also be added. The agreeable taste of molasses may make the fragments more attractive to animals. Urea is a source of nitrogen, which may be biologically converted to usable protein in cattle. Further, urea may substantially increase appetite in cattle, and aids the growth of micro-organisms helpful in digestion.

One preferred formulation includes protein meal, molasses, cement, urea, water, and salt. In one example, a solution may be formed by mixing urea with salt and combining with water. Molasses may then be added to the solution and mixed for 5-20 minutes. Separately, protein meal may be thoroughly mixed with cement in a dry environment. Copra meal may also be added at this stage. The solution is then kneaded into the dry mixture. The resulting mixture is poured into molds. It may be compacted in the molds. In another example, urea is mixed with hot water; then salt, molasses, protein meal, and cement may be introduced. In one example, the ingredients are added in that order, with cement introduced last.

In another example, cement is mixed with 35-50 percent of its weight in water and salt and then added to the other ingredients. This formulation results in a target having increased hardness. In the alternative, hot molasses, urea, salt, calcium oxide and meal may be mixed together (possibly introduced in that order) using a mixer, such as, for example, a horizontal paddle mixer.

Phosphorous (e.g., dicalcium phosphate) may be added to any of the above formulations, in an amount from 0 to 5 percent of total ingredients by weight.

Silage or grain (less than 10 percent of total ingredients by weight) may be added to any of the above formulations.

The amount of urea in any of the above formulations may be from 0 to 5 percent of total ingredients by weight. In some cases, it may advantageous to limit the amount of urea added to less than 5 percent of total ingredients by weight to prevent intoxication in case of rain. In some cases, the preferred amount may be less than 2 percent by weight.

It may be desirable to limit the amount of molasses added to less than 40 percent of total ingredients by weight to increase nutritional value. Formulations optimized for hardness may include 25 percent or less of molasses by total weight of ingredients.

Formulation 1
Hot water—10%
Urea—0-5%
Salt—5-10%
Hot molasses—20%
Protein Meal—30-45%
Cement—10-20%

In alternative methods, molasses and urea may be replaced by dried distillers grains and solubles, comprising complex carbohydrates from corn, barley, wheat or other grains (also known as condensed distillers solubles).

In other alternatives, a mixture is prepared by mixing protein meal or other farinaceous meal with a fat source from 5-20 percent by total weight of ingredients and water from 10-50 percent by total weight of ingredients. The mixture may be extruded at 180-300 degrees Fahrenheit, such as, for example, at approximately 220 degrees Fahrenheit. After drying, the extruded product may be ground into a powder, which may be mixed with a starch adhesive (e.g., dextrin having a DE of between 15 and 30) in an amount of 5 to 15 percent by weight of the mixture, after which the mixture is pressed into the target mold.

Other Animals

The mixtures above may be modified to include or substitute other food substances for protein meal if the targets are intended to be eaten by non-ruminant animals, such as fish, birds, or pigs. For birds especially, the inclusion of bird seed or farinaceous materials may be desirable.

Other modifications to the raw mixture formulation may be beneficial. For example, non-ruminants may not benefit from ingesting urea. Urea may also affect fish ponds and other wetlands in unpredictable ways. For any of these circumstances, a reduced-urea or non-urea target may be manufactured.

Alternative Manufacturing Processes

In alternative production techniques, mixtures described above may be extruded as a large cross-section extrusion, which is then truncated into a blank of roughly the required height of the target. After curing, the blank may be machined to arrive at the correct shape within precise tolerances.

In other techniques, a series of round die may be mounted to the extruder. For example, the round die may have co-extrusion die inserts arranged in a polar design. The extrusion may be truncated to form ring layers. The ring layers may be assembled and adhered using adhesives, or using binders such as cement.

In other embodiments, an extruder device having a pelleting head at the outlet end of the extruder barrel may be used to create smaller pellets which are then joined using one or more binders as described above. For example, components including protein meal or cereal grains, fat and/or molasses, along with water and steam, may be introduced into a preconditioner for mixing and heating. The preconditioned feed ingredients may be introduced into a cooking extruder. They may be transported by screw as they are being cooked by steam injection, causing gelatinization. The resultant feed may be "puffed" as it is forced through a die. Density may be adjusted using a product densification unit to achieve ideal density for flight and breakage characteristics, for example, or if it is otherwise desirable, such as, for example, in the case of sinking fish food type targets.

Finished targets may be coated with a carnuba based wax, food-grade shellac, or the like.

It is to be understood that varying processes may have associated advantages and disadvantages that recommend their use, and that all such variations are within the scope of the present disclosure.

The discussion above has focused primarily on embodiments of the disclosure where targets are made by molding a mixture including protein meal and cement. Other embodiments may be used with other types of food source, or employing other types of binder. It should be understood that the inventive concepts disclosed herein are capable of many modifications. To the extent such modifications fall within the scope of the appended claims and their equivalents, they are intended to be covered by this patent.

What is claimed is:

1. A frangible flying target comprising:

a body substantially formed from matter edible to animals, said body comprising a cured mixture, the mixture comprising protein meal and urea, wherein the mixture comprises between 5-20 percent cement by total weight of the mixture before curing and between 0.5-10 percent urea by total weight of the mixture before curing.

2. The target of claim 1, wherein the protein meal is enveloped in an edible binder.

3. A frangible flying target comprising:

a body substantially formed from matter edible to animals, said body comprising a cured mixture, the mixture comprising protein meal and urea, wherein the mixture comprises:

between 5-20 percent cement by total weight of the mixture before curing;

between 0.5-25 percent molasses by total weight of the mixture before curing;

between 0-10 percent salt by total weight of the mixture before curing;

between 0.5-10 percent urea by total weight of the mixture before curing; and water.

4. The target of claim 3, wherein the protein meal is enveloped in an edible binder.

* * * * *